US005255494A

United States Patent [19]

Doyle

[11] Patent Number: 5,255,494

[45] Date of Patent: Oct. 26, 1993

[54] METHOD AND APPARATUS FOR FORMING CARTON OPENING ARRANGEMENT, AND CARTONS MADE THEREBY

[75] Inventor: Eric P. Doyle, St. Paul, Minn.

[73] Assignee: Tetra Alfa Holdings S.A., Pully, Switzerland

[21] Appl. No.: 877,072

[22] Filed: May 1, 1992

Related U.S. Application Data

[63] Continuation-in-part of Ser. No. 804,603, Dec. 10, 1991, abandoned.

[51] Int. Cl.[5] ..... B65B 7/18

[52] U.S. Cl. ..... 53/477; 53/412; 53/370.4; 53/374.2; 493/87; 229/249

[58] Field of Search ..... 53/477, 410, 412, 375.9, 53/377.7, 133.1, 133.2, 370.9, 370.8, 370.7, 373.9, 373.8, 374.2, 371.9; 493/87; 206/631.3

[56] References Cited

U.S. PATENT DOCUMENTS

| | | | |
|---|---|---|---|
| 3,200,557 | 8/1965 | Schwenk | 53/477 |
| 3,309,841 | 3/1967 | Egleston et al. | 53/370.9 |
| 3,956,046 | 5/1976 | Tsuchiya et al. | 156/73.4 |
| 4,251,303 | 2/1981 | Deimel et al. | 156/73.1 |
| 4,403,465 | 9/1983 | Bachner | 53/477 |
| 4,518,377 | 5/1985 | Skinner | 493/87 X |
| 4,712,727 | 12/1987 | Wyberg | 206/631.3 |
| 4,756,426 | 7/1988 | Wyberg | 206/631.3 |
| 4,762,234 | 8/1988 | Wyberg | 206/631.3 |
| 4,792,048 | 12/1988 | Wyberg | 206/631.3 |
| 4,813,547 | 3/1989 | Wyberg | 206/631.3 |
| 4,813,548 | 3/1989 | Wyberg | 206/631.3 |
| 4,838,009 | 6/1989 | Connor et al. | 53/370.9 X |
| 4,860,902 | 8/1989 | Kieser | 206/631.3 |
| 4,869,372 | 9/1989 | Wyberg | 206/631.3 |
| 4,869,373 | 9/1989 | Wyberg | 206/631.3 |
| 4,872,562 | 10/1989 | Wyberg | 206/631.3 |
| 4,903,891 | 2/1990 | Gordon | 229/481 |
| 4,946,041 | 8/1990 | Poole | 236/621.1 |
| 4,989,736 | 2/1991 | Andersson et al. | 206/631.3 |

FOREIGN PATENT DOCUMENTS

| | | |
|---|---|---|
| 0028941 | 5/1981 | European Pat. Off. . |
| 0439958 | 8/1991 | European Pat. Off. . |
| 75/6322 | 10/1975 | South Africa . |

*Primary Examiner*—James F. Coan

*Attorney, Agent, or Firm*—Burns, Doane, Swecker & Mathis

[57] ABSTRACT

A process for forming an easy-opening arrangement for gable-top cartons is described. A tape is applied to the inside of the pouring spout in order to stiffen the panels, while reducing the force required to separate the thermoplastic seal. The tape is bonded to the thermoplastic surface layer of the carton by an adhesive. During the hot air heating of the carton top prior to sealing, the area where the tape is located is not exposed to the hot air. During closing of the sealing jaws, surfaces on the opposed faces of the sealing jaw urge the adhesive into the space above the edge of the pouring spout to form an impermeable seal. The location of the tape on the carton blank and the apparatus for heating and sealing the carton are also described.

10 Claims, 6 Drawing Sheets

Fig. 10
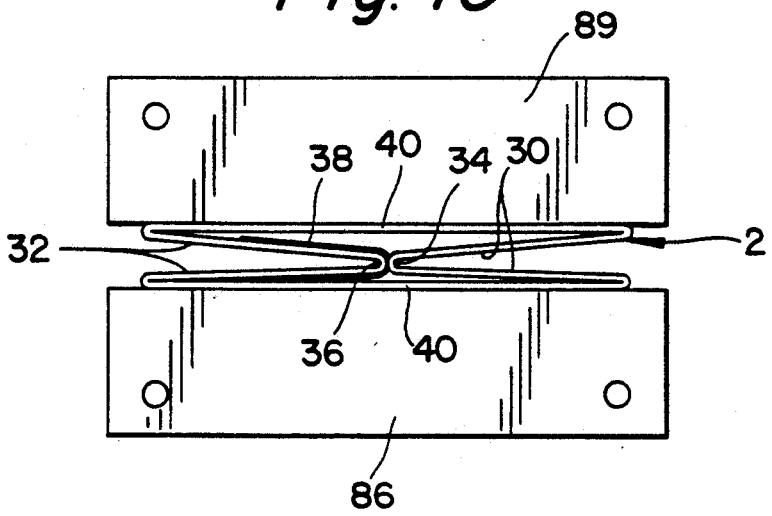
Fig. 11
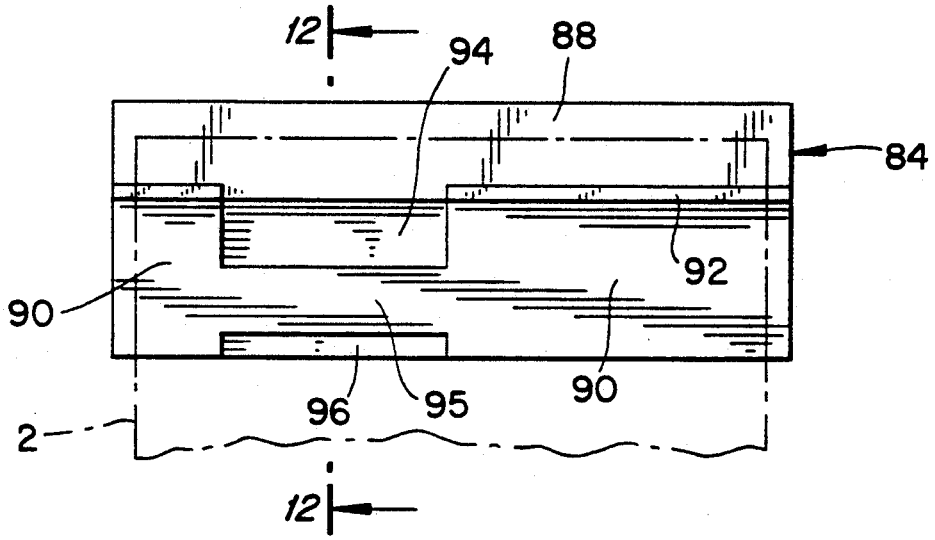
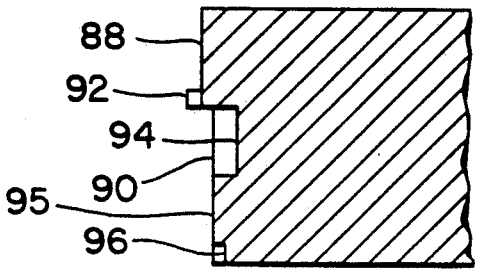
Fig. 12

METHOD AND APPARATUS FOR FORMING CARTON OPENING ARRANGEMENT, AND CARTONS MADE THEREBY

CROSS-REFERENCE TO RELATED APPLICATION

This application is a continuation-in-part of my copending U.S. patent application Ser. No. 07/804,603 filed Dec. 10, 1991, and now abandoned, entitled "Method and Apparatus for Forming Carton Opening Arrangement, and Cartons Made Thereby".

FIELD OF THE INVENTION

This invention relates to cartons for packaging liquid food products, and more particularly to methods and apparatus for forming and sealing the top opening for such cartons.

BACKGROUND OF THE INVENTION

Paperboard cartons are commonly used for distributing milk and juice. Typically, paperboard cartons are formed from flat blanks that have a central layer of paperboard and outer layers of polyethylene. A gas barrier layer may be included in the laminate. A common form of these cartons is referred to as a gable-top carton. This type of carton has four side walls and a flat bottom. The top of the carton is folded into a closing arrangement which resembles a roof. Along the ridge of the roof, a sealing fin projects upwardly. The laminate that forms the sealing fin is heated to soften the polyethylene. When the laminate is then pressed together along the sealing fin and cooled, so that the polyethylene layers form a secure bond.

In order to open the sealed carton, the sides of the roof are pulled apart to separate each half of the sealing fin between the end of the roof and the center of the ridge of the roof. The other half of the sealing fin remains sealed. The second step in the opening process requires unsealing the inside layers of the sealing fin, and this is done by swinging the sides of the roof further away from each other past the middle of the roof ridge, and then to urge the two sides toward each other with sufficient force to break the seal between the inside layers of the seal fin, which then swing outwardly to form a pouring spout.

Although the gable-top carton is used extensively, the opening arrangement has been criticized by consumers for the difficulty in opening and forming the pouring spout. Often, in conventional cartons it is necessary to actually pull the spout away from the center of the sealing fin with sufficient force to break the seal between the layers of the seal fin. When the seal fin is torn apart, all of the polyethylene may adhere to one side of the seal and, as a result, the rough surface of the paper is exposed. This rough paper surface is not only visually objectionable, it may be the source of bacteria if the carton remains open for a long time after its first use.

Various attempts have been made to improve the opening arrangement. One suggestion for improving the opening arrangement is disclosed in U.S. Pat. No. 4,712,727 which involves applying an adhesive-coated plastic strip on the inside of the carton blank overlapping the sealing fin. The plastic tape reduces the adhesion between the tape and the opposite polyethylene coating, thereby reducing the force required to open the sealing fin. The tape also strengthens the sealing fin so that in the second opening step in which the spout is formed, the sides of the sealing fin are able to withstand any tendency to buckle. This proposed arrangement does not perform satisfactorily, however, in carton-filling and sealing machines that are currently in use. The tape tends to move during the sealing operation, which prevents a hermetic seal and in some cases causes leakage of the contents of the carton to occur. Another problem with utilizing the tape is that in the sealing operation, the tape tends to wrinkle or become uneven. All of these problems lead to an ineffective seal, which permits $O_2$ permeation or product penetration. For a practical commercial use, the cartons must remain sealed until opened by the customer. For example, if even a minute channel through the sealing fin results from the use of the tape, air may enter the carton and prematurely spoil the contents. Also, in transporting and handling the carton, the contents may leak, particularly along the crease lines at the center of the sealing fin. As a practical matter, the integrity of the seal is essential to providing a commercially-viable carton opening arrangement.

There are various techniques for applying the tape to the surface of the carton blank. Typically, the tape has a coating of adhesive on one side and is bonded to the surface of the carton blank by the adhesive. The use of an adhesive at the location of the pouring spout obviously adds to the thickness of the sealing fin, and requires modification of conventional carton sealing equipment to accommodate the presence of the tape. Another problem is that it is intended that the adhesive at least partially extrude outward from the tape during the sealing operation. Due to the plastic nature of the adhesive, it does not provide a stable support for the tape, and this leads to displacement of the tape, wrinkling and distortion during the sealing operation.

OBJECTS AND SUMMARY OF THE INVENTION

It is an object of the present invention to provide a carton sealing method and apparatus which forms an effective seal utilizing a tape formed of stiffening material.

It is a further object of this invention to provide a method and apparatus for sealing a gable-top carton having a stiffening tape adhesively bonded to the interior surface of the carton blank at the pouring spout.

A further object of the invention is to provide a method and apparatus for controlling plastic flow of the adhesive to form an effective seal at the sealing fin when using a tape of stiffening material at the pouring spout.

These objects are accomplished in accordance with this invention by a gable-top carton blank of foldable polyethylene-coated material with bottom and side walls. The gable-top arrangement includes two roof panels sealed to one another along the sealing fin. At each end of the gable-top, side walls have back folding panels which are heat-sealed together in the sealing fin. The tape is adhesively bonded on the inside of the back folding panels on the end of the sealing fin which is to become the pouring spout when the carton is opened. The tape is located within the sealing fin and is compressed between the sealing jaws of a conventional carton filling and sealing machine.

The conventional carton filling and sealing machine has a seal heating area for applying heat to the sealing fin portion of the filled carton in order to soften the polyethylene coating for subsequent bonding. Immediately following the seal fin heating, the top of the carton is closed and clamped between sealing jaws with sufficient pressure to bond the parts of the carton blank in the seal fin. Subsequent cooling between cooling jaws causes the polyethylene surfaces to cool and form a secure bond in the sealing fin area. The apparatus in the seal fin heating avoids applying heat to the portion of the sealing fin area where the tape has been applied, while heat is applied to the remaining three sides of the carton. The sealing jaws are contoured to press the adhesive outwardly from beneath the tape and toward the edge of the pouring spout, so that when the sealing jaws close to clamp the sealing fin, the adhesive is trapped between the tape and the edge of the pouring spout and forms an effective seal against leakage of fluid around the tape in the sealing fin area.

DESCRIPTION OF THE DRAWINGS

A preferred embodiment of this invention is illustrated in the accompanying drawings, in which:

FIG. 10 is a top plan view of the sealing jaws partially closed on a carton top;

FIG. 11 is an elevational view of the face of the sealing jaw as viewed along the line 11—11 in FIG. 10;

FIG. 12 is a cross-sectional view of the sealing jaw along the line 12—12 in FIG. 11;

DETAILED DESCRIPTION

Figure 1:
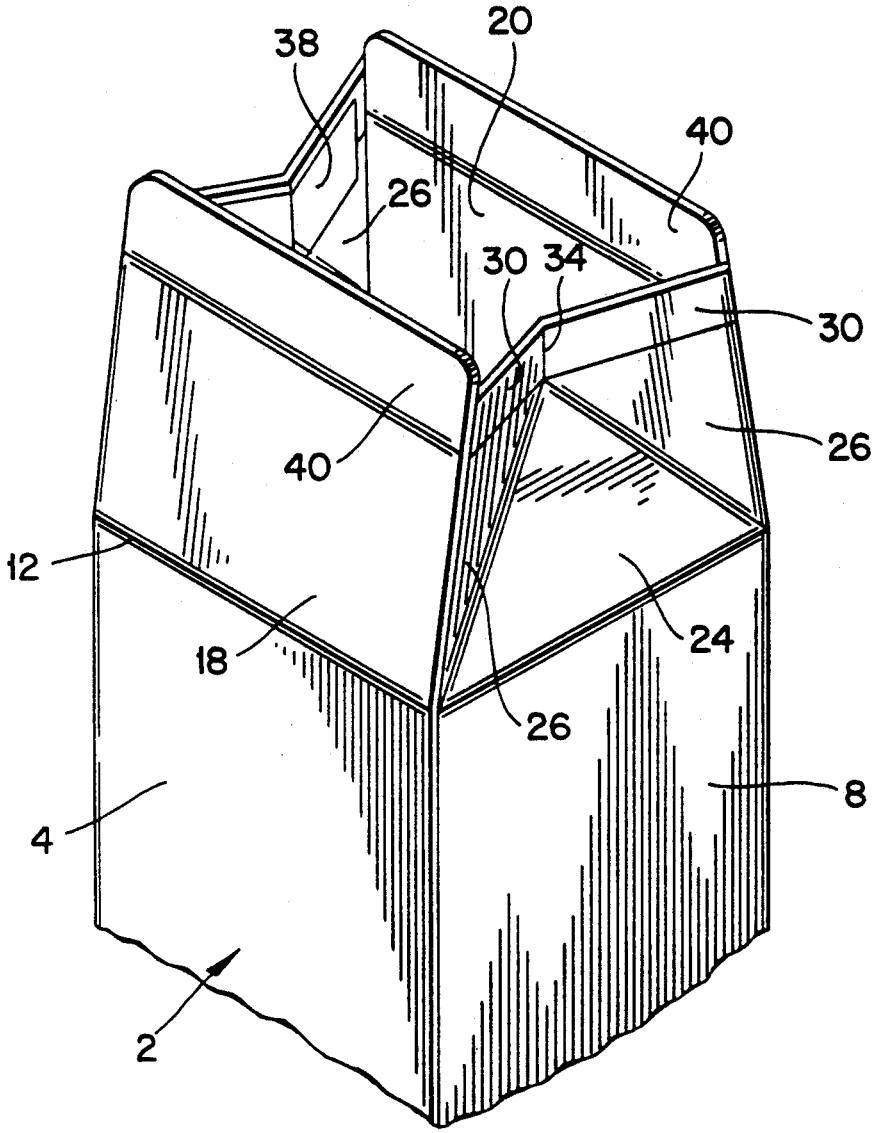
FIG. 1 is a perspective view of a carton showing the sealing fin area prior to closing and heat-sealing.
Figure 2:
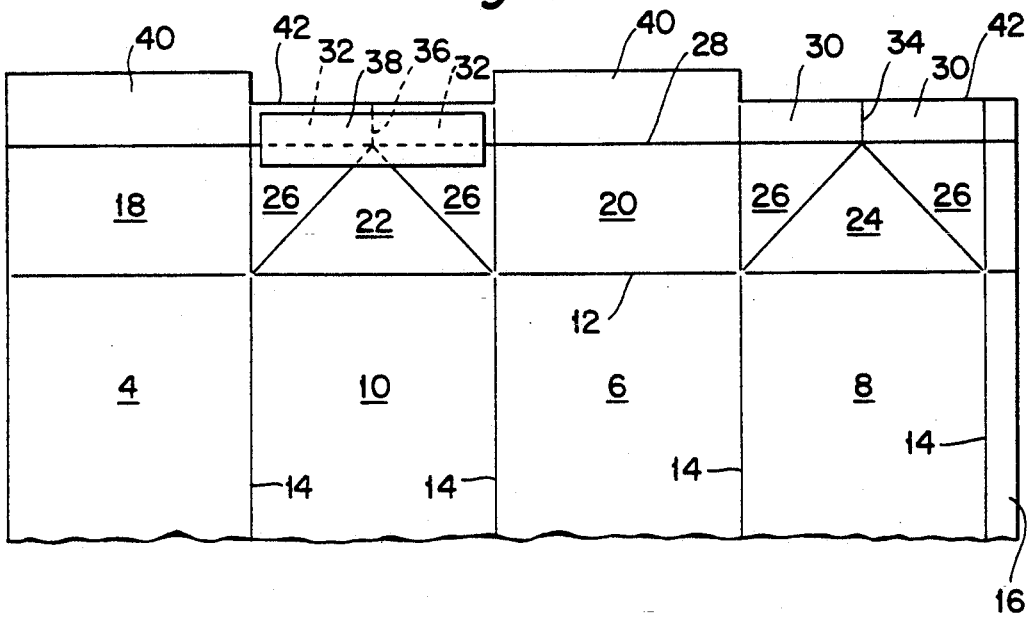
FIG. 2 is a plan view of a carton blank in accordance with this invention.

Referring to FIGS. 1 and 2, a gable-top carton 2 has a front wall 4, a back wall 6, and opposite side walls 8 and 10. The carton 2 has a closed bottom (not shown) which is formed in a conventional manner.

At the top of the carton 2, the front and back walls are folded along a crease line 12 which extends across the front wall and back wall and the two side walls. The various crease lines which are formed in the carton blank are shown in FIG. 2. Crease lines 14 are provided in the carton blank to form each of the corners of the carton 2. A sealing flap 16 is folded and sealed along the side wall 4 to form the carton as shown in FIG. 1.

The carton blank, as shown in FIG. 2, has main roof panels 18 and 20 which are extensions of the front and back walls 4 and 6. The carton blank has triangular end panels 22 and 24 and triangular back-folding panels 26. A crease line 28 in the carton blank is parallel to the crease line 12 and defines the sealing fin along the ridge of the sealed gable-top carton. On the opposite side of the crease line 28 from the triangular back-fold panels 26, the carton blank has rectangular fin panels 30 adjacent the end panel 24 and rectangular fin panels 32 adjacent the end panel 22. At the apex of the triangular end panel 24, a vertical crease line 34 is provided between the rectangular panels 30. A similar vertical crease line 36 is provided between the rectangular panels 32 at the apex of the triangular end panel 22. The main roof panels 18 and 20 include rectangular portions 40 which extend above the edges 42 of the fin panels 30 and 32, as shown in FIG. 2.

As shown in FIGS. 1 and 2, a strip of tape 38 is applied over the fin panels 32 and over a portion of the fold-back panels 26. The tape 38 has an adhesive layer which bonds the tape to the polyethylene coating on the carton panels. The tape is formed of a material that is weakly bonded by heat sealing to the polyethylene coating of the carton blank, or is incapable of forming a bond with the polyethylene, so that the exposed side of the tape does not stick to the adjacent surfaces of the carton when the carton is being opened. The tape material should be resistant to deformation under the heating conditions prevailing during the sealing process and be sufficiently stiff to facilitate the carton opening process. The adhesive that bonds the tape 38 to the carton blank should have the ability to form a strong bond between the tape and the polyethylene surface of the carton blank, so that upon opening the carton, the tape remains bonded to the fin panels 32. For example, the tape may be formed of unoriented polypropylene, metallic foil, polyester film or polycarbonate film. Suitable adhesives for bonding the tape to the polyethylene of the carton blank include ethylene vinyl acetate (EVA) copolymer, medium density polyethylene, and pressure-sensitive adhesive (PSA). A description of suitable tape material and adhesive is contained in U.S. Pat. No. 4,712,727. The tape 38 may also be formed of unoriented polypropylene, such as that used as a film backing in a pressure-sensitive adhesive tape marketed under the trademark "Y-8450" by Minnesota Mining and Manufacturing Company.

The spacing between the edge of the tape 38 and the edge 42 of the fin panels 32 is important in achieving a proper seal. If the edge of the tape 38 is too close to the edge 42, the tape will interfere with the flow of the adhesive over the edge 42. If the tape 38 is spaced too far from the edge 42, the adhesive will not fill the area along the edge 42. It has been found that the minimum gap between the edge of the tape and the edge 42 for an effective seal is 0.50 mm and the maximum gap is 1.5 mm.

Figure 4:
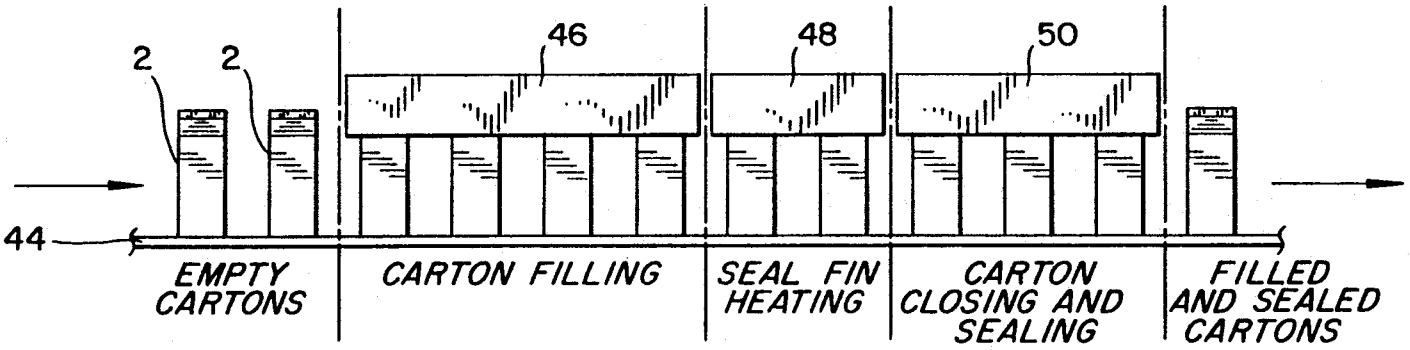
FIG. 4 is a schematic view of a conventional carton filling and sealing machine.

The process of filling and sealing the cartons is shown schematically in FIG. 4. Cartons 2 advance on a conveyor 44 and are spaced apart a predetermined distance. The cartons are filled with liquid by suitable filling equipment 46. After filling, the cartons pass through a one-carton station where the top of the carton is bent along the crease lines approximately to the position shown in FIG. 1. The cartons then advance to the seal fin heating station 48 where hot air is applied to the open top of the carton to soften the polyethylene coating on the carton material prior to sealing. The cartons then pass through the carton closing and sealing station 50 where the cartons are closed and sufficient pressure is applied to bond the heated polyethylene portions of the sealing fin. The filled and sealed cartons then pass out of the machine. A suitable conventional machine that performs this process is manufactured by Tetra Rex Packaging Systems, Inc. of St. Paul, Minn., and particularly Models LPX and TR-7.

Figure 5:
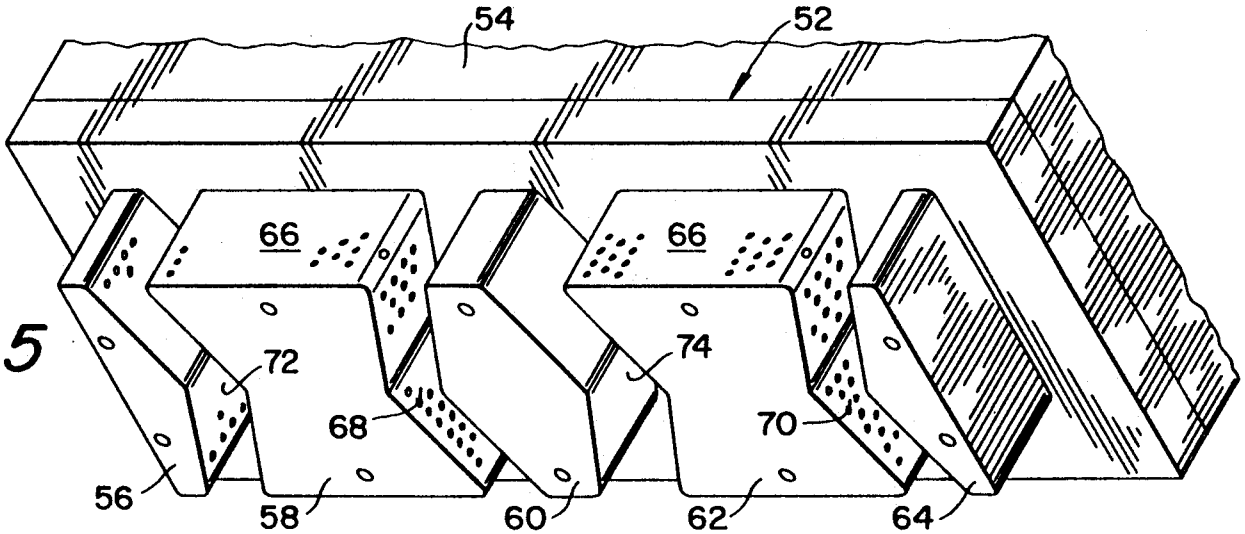
FIG. 5 is a perspective view of the top heater for the sealing fin area of the carton in accordance with this invention.

The method and apparatus of this invention are directed to the seal fin heating station 48 and the carton closing and sealing station 50. The seal fin heating station 48 supplies sterile heated air to a distributor 52 as shown in FIG. 5. The distributor is mounted on a plenum 54 which is connected with a source of heated air. The distributor 52 has five distributor elements 56, 58, 60, 62 and 64 which are arranged to receive two cartons simultaneously when the cartons are displaced vertically to fit into the slots between the elements 56 and 58, and 58 and 60, or between the slots formed by the elements 60 and 62, and 62 and 64. Referring to FIG. 1, it can be seen that the rectangular portions 40 of the carton are positioned on the sides 66 of the elements 58 and 62 and the fin panels 30 are positioned in the slot 68 between the elements 58 and 60 and in the slot 70 between the elements 62 and 64. The fin panels 32 to which the tape 38 is applied are received in the slot 72 between the elements 56 and 58 and in the slot 74 between the elements 60 and 62.

Sterile heated air flows from the plenum 54 through a plurality of holes in the side walls of the elements. The flow of heated air through the holes heats the polyethylene surfaces sufficiently to cause bonding between the surfaces of the carton material. In addition, the distributor elements are heated by the air from the plenum 54 so that the tape, adhesive and carton are heated by radiant heat. Typically, the carton is heated twice, since the cartons advance in a single step. For example, the first heating occurs in the slots 68 and 72, and the second heating occurs in the slots 70 and 74.

Figure 6:
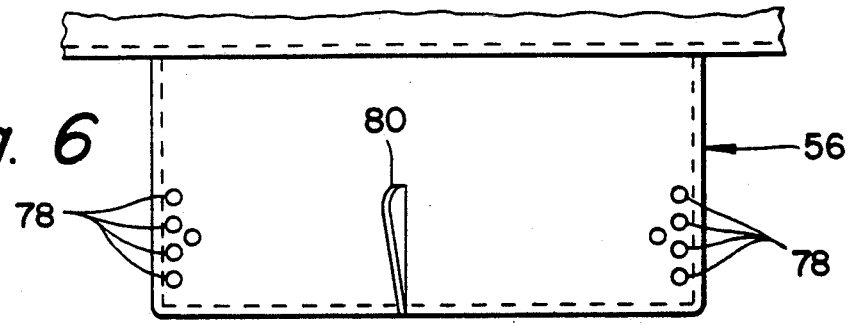
FIG. 6 is an elevational detail view of the outside air distribution element for the spout area.

FIG. 6 is an elevational view of the element 56 which forms a side of the slot 72 that is exposed to the outside of the carton panels 32. The element 56 has a plurality of holes 78 which direct sterile heated air against the outer surface of the carton blank along the crease line 14 which joins the rectangular fin panels 32 with the adjacent rectangular portions 40. At the center of the element 56, a looped guide 80 is aligned with the vertical crease line 36 and maintains the carton material at the proper distance from the air holes to assure a uniform distribution of the heated air.

Figure 7:
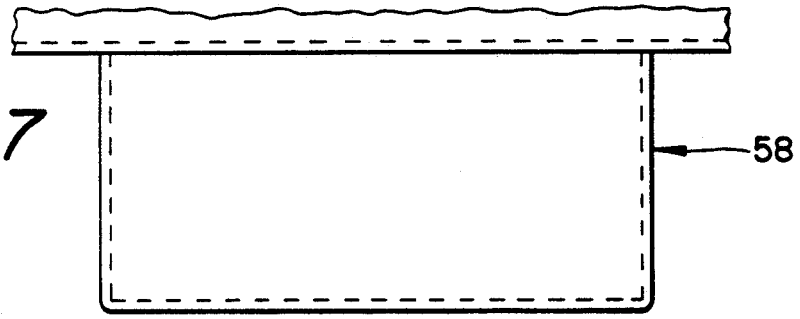
FIG. 7 is an elevational detail view of the inside air distribution element for the spout area.
Figure 8:
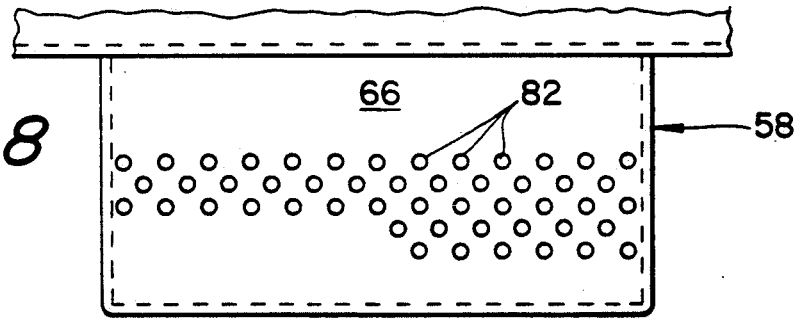
FIG. 8 is an elevational detail view of the inside air distribution element for the roof panels area.

FIG. 7 shows the opposite side of the slot 72 which is formed by the element 58. This side of the slot is inside the open top of the carton and is exposed to the tape and the inside of the carton panels 32. Since there are no air holes, the tape and adhesive are not heated by hot air, although there is some heating by radiant heat. The sides 66 of the element 58, which heat the rectangular portions 40 of the carton blank, are provided with the hole pattern as shown in FIG. 8. In this embodiment, the lower two rows of holes 82 that would be on the inside of the carton panel 40 against which the tape is folded (FIG. 10) are omitted in order to reduce the heating in this area. Similarly, the hole pattern on the opposite side of the element 58 is the mirror image of the hole pattern of FIG. 8. The same hole pattern is provided on both of the side walls of the distributor element 62.

Figure 9:
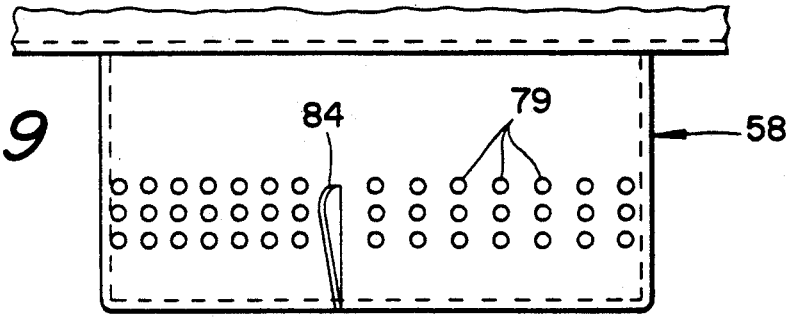
FIG. 9 is an elevational detail view of the inside air distribution element for the closed end of the sealing fin.

The side of the element 58 that forms the slot 68 has a pattern of holes that is shown in FIG. 9. The hot air which flows out of the holes 79 heats the rectangular fin panels 30 on the inside of the carton. On the opposite side of the slot 68, the element 60 has the same pattern of holes as is shown in FIG. 9 for heating the outside of the rectangular fin panels 30. A loop guide 84 is provided on the element 58 to be aligned with the vertical crease line 34 and to maintain the carton blank the proper distance from the air hole 79 to provide uniform distribution of the heated air.

The sides of the elements 60 and 62 which form the slot 74 do not have any holes, so that the amount of heat applied to the carton around the tape is minimized. The pattern of holes in the elements 62 and 64 on opposite sides of the slot 70 is the same as the pattern of holes in the slot 68. As a result of passing through the top heater as shown in FIG. 5, all of the carton surfaces which are to be sealed together are heated, and the tape 38 is heated to a lesser degree. Preferably, sufficient heat is applied to cause the adhesive to flow when clamped between the sealing jaws.

Referring to FIG. 4, after the top of the cartons has been heated by the air in the seal fin heating station 48, the cartons progress on the conveyor 44 to the carton closing and sealing station 50. In accordance with conventional practice, the carton closing and sealing station has three sets of jaws which are spaced apart a distance corresponding to the advance of the conveyor, so that each carton is clamped sequentially between the first, second and third sets of jaws. The first set of jaws is cooled, so that upon closing of the jaws to clamp the sealing fins between the jaws, the initial sealing of the seal fin takes place. The second and third sets of jaws are also maintained at a cool temperature in order to absorb heat from the carton seal fin.

The first set of sealing jaws 84 and 86 are shown in FIG. 10 with the top of the carton 2 partially compressed between the sealing jaws. The rectangular portions 40 (FIGS. 1 and 2) engage the face of the respective sealing jaws 84 and 86. At the left side of the sealing jaws as shown in FIG. 10, the fin panels 32 on which the tape 38 has been applied are folded together. Similarly, the fin panels 30 at the right side of the sealing jaws as shown in FIG. 10 are folded together, so that the vertical creases 34 and 36 between the respective fin panels are positioned in close proximity to each other at the center of the sealing jaws.

As shown in FIG. 11, the sealing jaw 84 has an upper portion 88, a lower portion 90 and a horizontal rib 92. A carton 2 is shown in phantom lines in FIG. 11 in relation to the sealing jaw when the jaws are closed. The horizontal rib 92 is positioned just above the edge 42 of the carton (FIG. 2). The sealing jaw 84 has an upper relief area 94 and a lower relief area 96 which are separated from each other by a bar portion 95, which has the same depth as the lower portion 90 (FIG. 12). The recesses 94 and 96 extend horizontally from the center of the sealing jaw where the vertical fold lines 34 and 36 of the carton are located outwardly approximately the same distance as the length of the tape 38. As shown in FIG. 12, the upper relief area 94 is recessed from the lower area 96. The opposite sealing jaw 86 has the same contour as the sealing jaw 84 that is shown in FIGS. 11 and 12, except that the face of the sealing jaw 86 is the mirror image of the contour shown in FIGS. 11 and 12, so that the relief areas 94 and 96 in the sealing jaw 84 are aligned with corresponding relief areas in the sealing jaw 86.

Since the rectangular portions 40 project upwardly from the edges 42 during the sealing operation, there are only two layers of carton material that are pressed together by the top portion 88 of the sealing jaw 84, while four thicknesses of the carton, namely the fin panels 32 and the rectangular portions 40 at the left side of the carton as viewed in FIG. 10, and the fin panels 30 and the rectangular portions 40 at the right side of the carton as viewed in FIG. 10.

Figure 3:
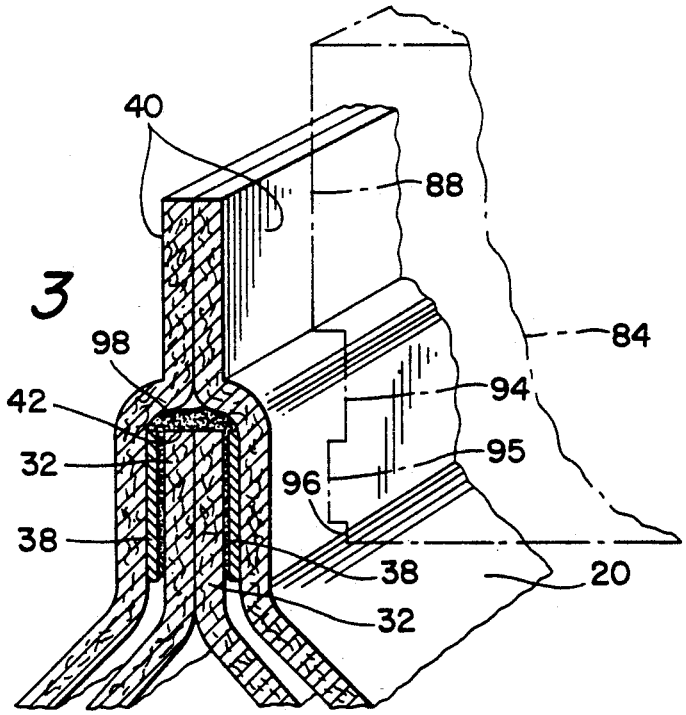
FIG. 3 is a cross-sectional view of the sealing fin after heat-sealing, in accordance with this invention.

Referring to FIG. 3, the sealing jaw 84 is shown in phantom lines to illustrate the relationship of the opposed faces of the sealing jaws 84 and 86 during the heat sealing operation. The upper relief area 94 is aligned with the lower portion of the tape 38 on opposite sides of the sealing fin, while the lower relief area 96 provides relief along the sealing fin crease line 28 and along the lower edge of the tape 38. Upon closing of the sealing jaws, the pressure differential between the bar portion 95 and the relief area 94 causes the adhesive to flow from between the tape and the panels 32 and upwardly into the area between the upper relief areas 94 of the sealing jaws 84 and 86. Thus, the upper relief 94 provides an expansion area for the adhesive to accumulate. The adhesive is shown schematically at 98 in FIG. 3 and flows across the upper edges 42 of the panels 32 to form an effective seal between the upper portions 40 of the sealing fin and between the fin panels 32. Since the tape 38 is heated only by radiant heat and no direct hot air is applied to the surface of the tape, it has sufficient stiffness to resist wrinkling or displacement during the heat sealing operation.

The second and third sets of cooling jaws which are provided in the carton closing and sealing station have substantially the same contour as the sealing jaws 84 and 86, except that the horizontal rib 92 and reliefs 94 and 96 are omitted. The two sets of cooling jaws are maintained at a sufficiently low temperature to cause the polyethylene surfaces of the carton blank to solidify and to form a secure bond between adjoining panels. Similarly, the adhesive 98 in the tape solidifies and remains in the location shown in FIG. 3.

The desired flow of the adhesive is achieved by controlling the compression between the sealing jaws 84 and 86 and between the cooling jaws. Two layers 40 at the top of the sealing fin are compressed between the upper portion 88, four layers including the panels 30 are compressed between the lower portion 90 (FIG. 11) and in the area of the tape 38, four layers are compressed between the lower relief 96 (FIG. 11), and adjacent the edge 42 of the panels 32 are compressed between the upper relief 94. The preferred gaps between these various compression surfaces of the sealing jaws 84, 86 for carton material having a thickness of 0.7 mm is:

| | Surface | Gap | Compression |
|---|---|---|---|
| 2-layer | 88 | 1 mm | 0.4 mm |
| 4-layer | 90 + 95 | 1.9 mm | 0.9 mm |
| Upper tape relief | 94 | 2.4 mm | −0.1 mm |
| Lower tape relief | 96 | 2.9 mm | 0.4 mm |
| Rib | 92 | 0.7 mm | 0.7 mm |

In the second and third pairs of cooling jaws, surfaces corresponding to surfaces 88 and 90 in FIGS. 11 and 12 are provided on the jaws. The rib 92, and reliefs 94 and 96 of the first pair of cooling jaws are omitted from the second and third pairs of cooling jaws. The preferred gaps are as follows:

| | Surface | Gap | Compression |
|---|---|---|---|
| 2-layer | 88 | 0.75 mm | 0.65 mm |

-continued

| | Surface | Gap | Compression |
|---|---|---|---|
| 4-layer | 90 + 95 | 1.9 mm | 0.9 mm |
| 5th panel | | 2.4 mm | 0.4 mm |

EXAMPLE

One-half gallon cartons formed of paperboard-aluminum foil laminate having polyethylene coating on the inner and outer surfaces were filled and sealed in accordance with this invention utilizing an LPX forming, filling and sealing machine, Model 102 manufactured by Tetra Rex Packaging Systems, Inc. of St. Paul, Minn. The sterile air which was supplied to the distributor plenum at the seal fin heating station was heated to 270° C. The distributor elements had the configuration shown in FIG. 5, with the hole patterns shown in FIGS. 6–9. No holes were provided in the distributor which was exposed to the position of the tape on the inside of the carton (FIG. 7). The sealing jaws had a contour that corresponds to the sealing jaws 84 and 86 in FIGS. 10–12. The horizontal rib 92 had the greatest projection as measured from the back of the sealing jaw. The top portion 88 was recessed inwardly a distance of 0.15 mm from the outer surface of the rib 92. The lower portion 90 of the sealing jaw was spaced 0.60 mm from the surface of the horizontal rib. The upper relief 94 was spaced inwardly 1.10 mm and the lower relief 96 was spaced inwardly relative to the horizontal rib a distance of 0.85 mm. Thus, the upper relief was spaced inwardly from the lower relief by 0.25 mm. The upper relief 94 had a width of 5 mm. The tape used for the seal was manufactured by Minnesota Mining and Manufacturing Company of St. Paul, Minn. The carton thickness was, 0.7 mm. The tape was 0.17 mm thick, approximately 2.54 cm. wide and 7.0 cm. long, and was applied to the inside surface of the fin panels. The tape is marketed under Specification No. Y-8450 and is formed of unoriented polypropylene. Any material which is unaffected by the temperature and pressure encountered in the carton sealing operation can be used for the tape 38. The depth of the recess 94 relative to the lower portion 90 should be approximately 2 times the thickness of the combined thickness of the tape and adhesive. The depth of the lower recess 96 is preferably slightly less than the thickness of the tape.

The purpose of applying a tape on the inside of the pouring spout in accordance with this invention is to make the carton easier to open by reducing the force necessary to break the seal, but yet providing a secure seal which reliably prevents leakage through the top of the sealed carton. A test procedure has been devised to measure the force required for the second stage opening of gable-top cartons in accordance with this invention as compared to prior cartons containing a tape in the pouring spout (manufactured according to U.S. Pat. No. 4,712,727). In the prior process, heat was applied to the tape as well as the other portions of the open gable-top of the carton prior to clamping between the sealing jaws. The sealing jaws were provided with a recess corresponding to the thickness of the tape and layer of adhesive. As a result of using this process, the prior cartons were harder to open.

Figure 13:
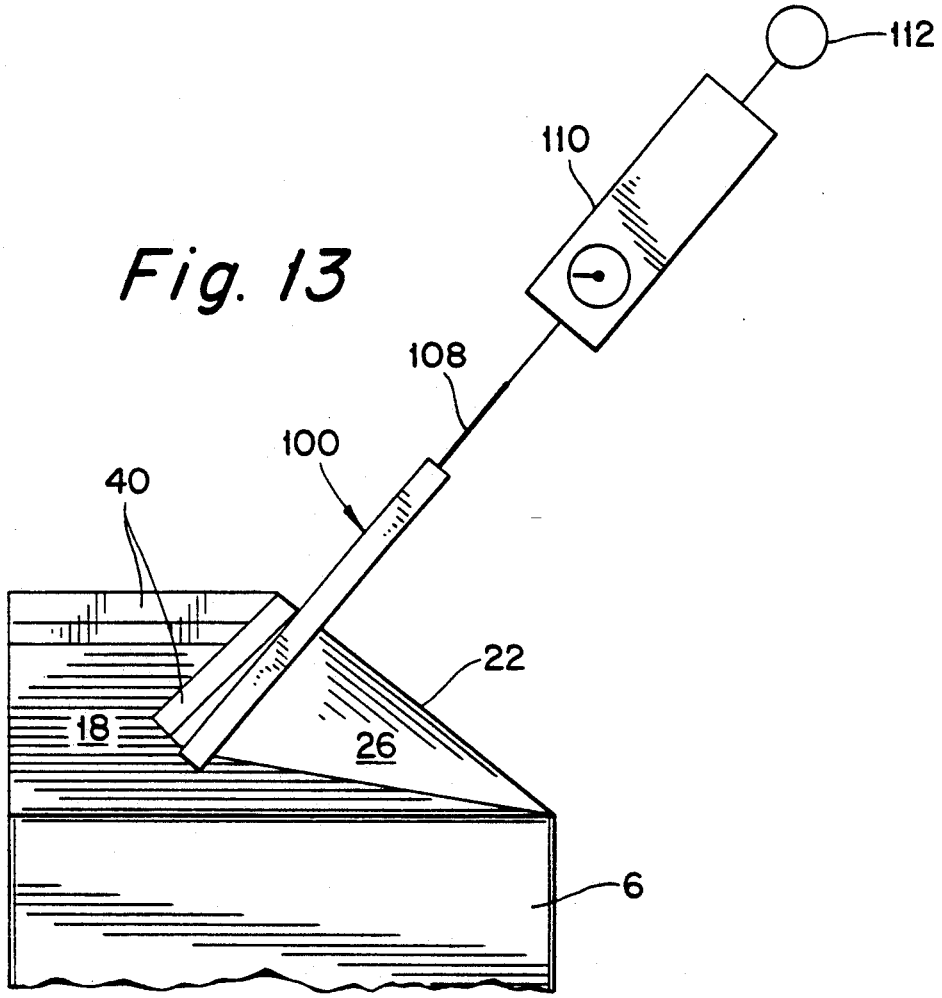
FIG. 13 is a schematic view of test apparatus for measuring second stage opening force.
Figure 14:
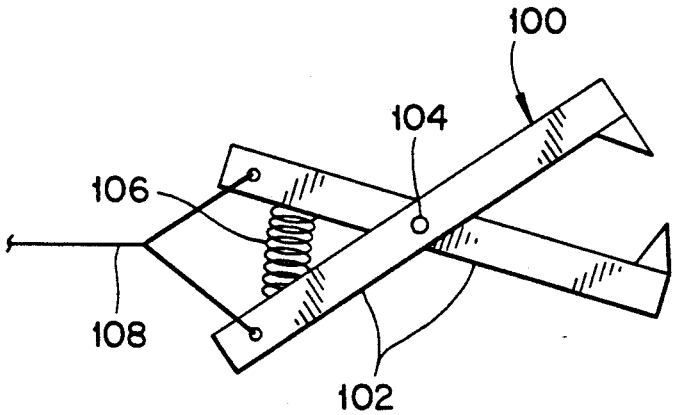
FIG. 14 is a top plan view of the opening tool.

The test of opening force is performed by opening the spout end of the seal fin by manually separating the rectangular portions 40 and folding them back to the position shown in FIG. 13. This may be referred to as the first stage opening. The second stage opening involves applying a compressive force toward the center of the pouring spout by grasping the outer ends of the rectangular portion 40 in order to peel the adhesive apart starting from the vertical crease 36 (FIG. 2). In order to measure the force required for the second stage opening, an opening tool 100 is attached at the outer ends of the seal fin, as shown in FIG. 13. The opening tool 100 has a pair of levers 102 hinged at the center by a pin 104. The levers 102 are urged toward a closed position by a spring 106. The ends of the levers 102 are connected by cables 108 to a force gauge 110 which has a pull ring 112. By pulling on the ring 112, a force is applied through the opening tool 100 to the seal fin 40, and the force gauge 110 indicates the maximum force that was necessary to cause the second stage opening to occur.

Table I shows the tape force in pounds and newtons that were required for the second stage of opening of 50 cartons made according to the prior process:

TABLE I

| CARTON | Tape FORCE (LBS) | FORCE (NTS) |
|---|---|---|
| 1 | 5 | 22 |
| 2 | 5 | 22 |
| 3 | 6 | 27 |
| 4 | 5 | 22 |
| 5 | 5.5 | 24 |
| 6 | 5 | 22 |
| 7 | 6 | 27 |
| 8 | 7 | 31 |
| 9 | 5 | 22 |
| 10 | 6 | 27 |
| 11 | 6 | 27 |
| 12 | 5 | 22 |
| 13 | 5 | 22 |
| 14 | 5 | 22 |
| 15 | 3 | 13 |
| 16 | 5.5 | 24 |
| 17 | 4 | 18 |
| 18 | 5 | 22 |
| 19 | 4.5 | 20 |
| 20 | 4 | 18 |
| 21 | 6 | 27 |
| 22 | 5 | 22 |
| 23 | 5 | 22 |
| 24 | 3 | 13 |
| 25 | 5 | 22 |
| 26 | 5 | 22 |
| 27 | 6 | 36 |
| 28 | 7 | 31 |
| 29 | 6 | 27 |
| 30 | 6 | 27 |
| 31 | 4 | 18 |
| 32 | 12 | 53 |
| 33 | 7 | 31 |
| 34 | 6 | 27 |
| 35 | 7.5 | 33 |
| 36 | 9 | 40 |
| 37 | 10 | 44 |
| 38 | 5 | 22 |
| 39 | 5 | 22 |
| 40 | 6 | 27 |
| 41 | 10 | 44 |
| 42 | 5 | 22 |
| 43 | 5 | 22 |
| 44 | 4 | 18 |
| 45 | 7 | 31 |
| 46 | 4 | 18 |
| 47 | 7.5 | 33 |
| 48 | 6.5 | 29 |
| 49 | 3 | 13 |
| 50 | 8 | 36 |
| Average | 5.8 | 26 |
| STDEV | 2 | 8 |

As can be seen from Table I, the average force required is 5.8 pounds, or 26 newtons.

A similar test was conducted utilizing 100 gable-top cartons that had been heated and sealed in accordance with this invention. In this test, the same type of tape (with adhesive) was used as was used in the test reported in Table I. The results of this test are shown in the accompanying Table II:

TABLE II

| CARTON | TAX (329) FORCE (LBS) | FORCE (NTS) |
|---|---|---|
| 1 | 5.2 | 23 |
| 2 | 6.4 | 24 |
| 3 | 6.3 | 24 |
| 4 | 2.6 | 11 |
| 5 | 5.3 | 24 |
| 6 | 5.7 | 26 |
| 7 | 3 | 13 |
| 8 | 2.6 | 12 |
| 9 | 4.1 | 18 |
| 10 | 3.1 | 14 |
| 11 | 4.3 | 19 |
| 12 | 4.4 | 20 |
| 13 | 3.2 | 14 |
| 14 | 2.6 | 11 |
| 15 | 2.6 | 12 |
| 16 | 3 | 13 |
| 17 | 2.6 | 12 |
| 18 | 1.7 | 8 |
| 19 | 3.4 | 16 |
| 20 | 2.6 | 11 |
| 21 | 4 | 18 |
| 22 | 2.4 | 11 |
| 23 | 2 | 9 |
| 24 | 1.9 | 8 |
| 25 | 1.8 | 8 |
| 26 | 4.5 | 20 |
| 27 | 2.5 | 11 |
| 28 | 3 | 13 |
| 29 | 3.6 | 16 |
| 30 | 4.6 | 20 |
| 31 | 3.2 | 14 |
| 33 | 4.3 | 19 |
| 34 | 3.1 | 14 |
| 35 | 3.8 | 17 |
| 36 | 3 | 13 |
| 37 | 3.6 | 16 |
| 38 | 2.9 | 13 |
| 39 | 3.9 | 17 |
| 40 | 3.5 | 16 |
| 41 | 3.2 | 14 |
| 42 | 4.5 | 20 |
| 43 | 3.6 | 16 |
| 44 | 3.6 | 16 |
| 45 | 3.8 | 17 |
| 46 | 3.6 | 16 |
| 47 | 2.6 | 12 |
| 48 | 3.1 | 14 |
| 49 | 6.5 | 24 |
| 50 | 3.4 | 15 |
| 51 | 3.7 | 16 |
| 52 | 3.8 | 16 |
| 53 | 3.5 | 16 |
| 54 | 4.6 | 20 |
| 55 | 4.6 | 20 |
| 56 | 2.1 | 9 |
| 57 | 2.1 | 9 |
| 58 | 2.4 | 11 |
| 59 | 1.8 | 8 |
| 60 | 2.0 | 13 |
| 62 | 3.6 | 16 |
| 63 | 3.2 | 14 |
| 64 | 3.4 | 15 |
| 65 | 3.6 | 16 |
| 66 | 2.2 | 10 |
| 67 | 2 | 9 |
| 69 | 2.6 | 12 |
| 70 | 2.6 | 12 |
| 71 | 1.7 | 8 |
| 72 | 2.1 | 9 |

TABLE II-continued

| CARTON | TAX (329) FORCE (LBS) | FORCE (NTS) |
|---|---|---|
| 73 | 2.6 | 12 |
| 74 | 2.4 | 11 |
| 75 | 2.2 | 10 |
| 76 | 2.4 | 11 |
| 77 | 3.6 | 16 |
| 78 | 3 | 13 |
| 79 | 2.9 | 13 |
| 80 | 2.1 | 9 |
| 81 | 2 | 9 |
| 82 | 2.6 | 12 |
| 83 | 2.8 | 12 |
| 85 | 2.9 | 13 |
| 86 | 2.4 | 11 |
| 87 | 2.6 | 12 |
| 88 | 2.4 | 11 |
| 89 | 2.1 | 9 |
| 90 | 3.4 | 15 |
| 91 | 2.1 | 9 |
| 93 | 3.6 | 16 |
| 94 | 2 | 9 |
| 95 | 2 | 9 |
| 96 | 2 | 9 |
| 97 | 2.3 | 10 |
| 98 | 3.1 | 14 |
| 99 | 3.6 | 16 |
| 100 | 3.1 | 14 |
| 61* | 0 | 0 |
| 68* | 0 | 0 |
| 84* | 0 | 0 |
| 92* | 0 | 0 |
| AVERAGE | 3.49 | 15.51 |
| STDEV | 1.01 | 4.48 |
| MAX | 5.7 | 25.36 |
| MIN | 1.70 | 7.56 |

*NOTES OPERATOR ERROR-OPENING TOOL SLIPPED

As can be seen from Table II, cartons in which the tape 38 is not heated by the air holes and in which the tape is placed so that the edge of the tape is between 0.75 mm and 1.50 mm from the edge 42 of the panels results in an average second stage force of 3.49 lbs. or 15.51 newtons. Thus, comparing the results of Table I with Table II shows a reduction of average opening force by more than one-third.

While this invention has been illustrated and described in connection with a preferred embodiment, it is recognized that variations and changes may be made therein without departing from the invention as set forth in the claims.

What is claimed is:

1. Apparatus for closing and sealing cartons of the type having a bottom, side walls, front and back walls, a gable-top heat-sealed closure in which the front and back walls are sealed together and the side walls have fin panels that are folded back and sealed between the front and back walls in a sealing fin along the ridge of the gable, and having an openable closure in which the sealing fin may be separated to expose the fin panels and by separating the fin panels from the front and back walls in the seal fin to form a pouring spout, the pouring spout having a reinforcing tape bonded by an adhesive to the interior surface along the edge of the fin panels, the apparatus comprising:

filling means for filling liquid content in the carton through the open top;

heater means for heating the front and back walls and the fin panels on one of the side walls while avoiding heating of the reinforcing tape;

closing means for closing the gable-top of the carton, said closing means including means for displacing the adhesive toward the edge of the fin panels while maintaining the position of the tape, said closing means including a pair of opposed sealing jaws, said sealing jaws being positioned for clamping the gable top of a carton between them, said sealing jaws each have clamping surfaces in position for clamping the gable top of a carton between them, said clamping surface each having a recess in said clamping surface, said recess overlying the edge of the fin panels and the upper edge of the reinforcing tape when a carton is clamped between the clamping surface, said clamping surfaces each including a second recess which overlies the lower edge of the tape.

2. The apparatus according to claim 1 wherein the first recess in each clamping surface has a depth that is greater than one-half of the combined thickness of the fin portions and the front and back walls and the tape in the sealing fin.

3. Apparatus for closing and sealing cartons of the type having a bottom, side walls, front and back walls, a gable-top heat-sealed closure in which the front and back walls are sealed together and the side walls have fin panels that are folded back and sealed between the front and back walls in a sealing fin along the ridge of the gable, and having an openable closure in which the sealing fin may be separated to expose the fin panels and by separating the fin panels from the front and back walls in the seal fin to form a pouring spout, the pouring spout having a reinforcing tape bonded by an adhesive to the interior surface along the edge of the fin panels, the apparatus comprising:

filling means for filling liquid contents in the carton through the top when the top is open;

heater means for heating the front and back walls and the fin panels on one of the side walls;

closing means for closing the gable-top of the carton, said closing means including means for causing at least some of said adhesive to be displaced into a region located between upper edges of the fin panels and an upper portion of the sealing fin while maintaining the position of the tape.

4. The apparatus according to claim 3, wherein said heating means includes means for directing heated air at the front and back walls and the fin panels of the one side wall while not directing heated air at the reinforcing tape.

5. The apparatus according to claim 3 wherein said closing means includes a pair of opposed sealing jaws, said sealing jaws being positioned for clamping the gable top of a carton between them.

6. The apparatus according to claim 5 wherein said sealing jaws each have clamping surfaces in position for clamping the gable top of a carton between them, said clamping surfaces each having a recess in said surface, said recess overlying the edge of the fin panels and the upper edge of the reinforcing tape when a carton is clamped between the clamping surfaces.

7. The apparatus according to claim 3, wherein said closing means includes two opposed sealing jaws and said heating means heats said adhesive by radiant heat, said means for causing at least some of the adhesive to be displaced including each of said sealing jaws being provided with a bar portion for applying pressure to the sealing fin to cause the heated adhesive to flow and a relief area that is recessed with respect to said bar portion for allowing the heated adhesive to flow into the region located between the upper edges of the fin panels and the upper portion of the sealing fin, the relief area being positioned above said bar portion.

8. The apparatus according to claim 7, wherein said relief area is an upper relief area, and including a lower relief area that is recessed with respect to said bar portion, said bar portion being positioned between said upper and lower relief areas.

9. The apparatus according to claim 3 wherein said heater means includes a plurality of distributor elements spaced apart to form slots to receive portions of an open gable-top carton, said heater means including means for supplying heated air to said distributor elements.

10. The apparatus according to claim 9 wherein one of said slots is positioned to receive the portion of the carton top where the reinforcing tape is located, said one slot having opposite walls, one of said slot walls having a plurality of holes directing heated air against the corners between the walls of the carton to soften the thermoplastic coating, and the other of said slot walls having an absence of holes, whereby the reinforcing tape is heated only by radiant heat while the corners of the carton top are heated by air from said holes.

* * * * *